US008161764B2

(12) United States Patent
Benitsch et al.

(10) Patent No.: US 8,161,764 B2
(45) Date of Patent: Apr. 24, 2012

(54) BUILT-IN REFRIGERATOR

(75) Inventors: Roland Benitsch, Nattheim (DE); Siegfried Grasy, Dornstadt (DE); Thorsten Kusnik, Bächingen (DE); Wolfgang Nuiding, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 831 days.

(21) Appl. No.: 12/225,947

(22) PCT Filed: Mar. 12, 2007

(86) PCT No.: PCT/EP2007/052293

§ 371 (c)(1),
(2), (4) Date: Oct. 3, 2008

(87) PCT Pub. No.: WO2007/115878

PCT Pub. Date: Oct. 18, 2007

(65) Prior Publication Data

US 2009/0272140 A1 Nov. 5, 2009

(30) Foreign Application Priority Data

Apr. 5, 2006 (DE) ..... 20 2006 005 547 U

(51) Int. Cl.
*F25B 21/14* (2006.01)

(52) U.S. Cl. ..... 62/291

(58) Field of Classification Search ..... 62/291, 62/302, 382, 259.1, 407, 448, 498; 312/116, 312/126

See application file for complete search history.

(56) References Cited

U.S. PATENT DOCUMENTS

| | | | | |
|---|---|---|---|---|
| 4,783,971 | A * | 11/1988 | Alba | 62/291 |
| 5,460,010 | A * | 10/1995 | Kobayashi et al. | 62/187 |
| 5,499,514 | A * | 3/1996 | Ho | 62/291 |
| 6,341,830 | B1 * | 1/2002 | Chun | 312/406.2 |
| 6,666,045 | B1 * | 12/2003 | Song | 62/441 |
| 6,672,840 | B2 * | 1/2004 | Jung et al. | 416/238 |
| 6,688,126 | B1 * | 2/2004 | Kim et al. | 62/258 |
| 6,718,793 | B2 * | 4/2004 | Lee | 62/453 |
| 6,817,208 | B2 * | 11/2004 | Choi et al. | 62/408 |
| 6,926,073 | B2 * | 8/2005 | Lee | 165/121 |
| 7,325,412 | B2 * | 2/2008 | Yun et al. | 62/295 |
| 7,484,707 | B2 * | 2/2009 | Lee et al. | 248/649 |
| 2002/0069669 | A1 * | 6/2002 | Lee | 62/525 |
| 2004/0003618 | A1 | 1/2004 | Kim et al. | |
| 2004/0016255 | A1 | 1/2004 | Kim et al. | |

FOREIGN PATENT DOCUMENTS

DE 199 33 603 1/2001

(Continued)

OTHER PUBLICATIONS

International Search Report PCT/EP2007/052293.

(Continued)

*Primary Examiner* — Mohammad Ali

(74) *Attorney, Agent, or Firm* — James E. Howard; Andre Pallapies

(57) ABSTRACT

A built-in refrigerator comprising a carcass, in the lower rear area of which a machine compartment is formed. Said machine compartment is closed at least in part by means of a rear wall. The rear wall delimits a first air passage of the machine compartment at the level of a support area of the carcass.

24 Claims, 3 Drawing Sheets

FOREIGN PATENT DOCUMENTS

| | | | |
|---|---|---|---|
| EP | 0 190 794 | | 8/1986 |
| EP | 0 718 570 | | 6/1996 |
| SU | 1742602 | A1 | 6/1992 |
| WO | WO 2006/058818 | | 6/2006 |
| WO | WO 2006/058819 | | 6/2006 |

OTHER PUBLICATIONS

B.S. Babakin, "Household Refrigerating and Freezing Appliances", Moscow 1998.

* cited by examiner

Fig. 6
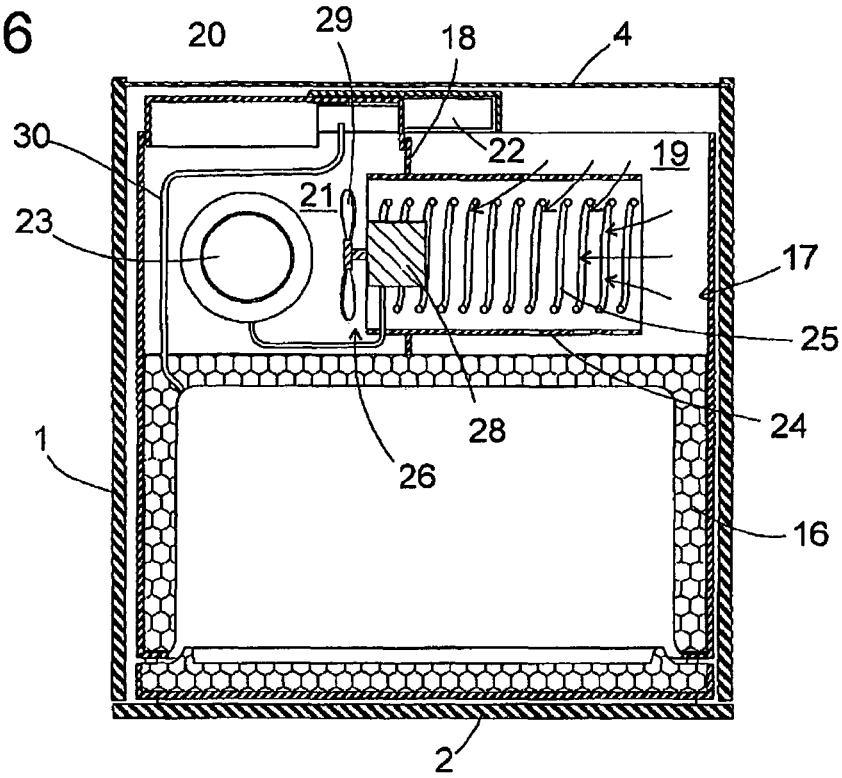
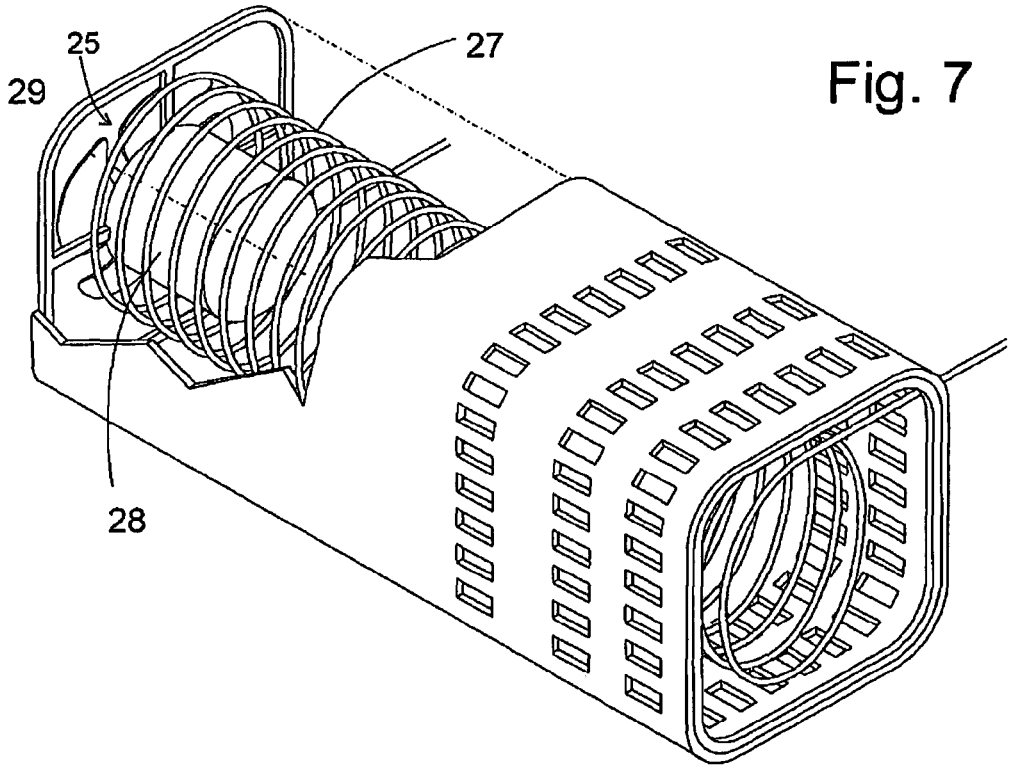
Fig. 7

BUILT-IN REFRIGERATOR

BACKGROUND OF THE INVENTION

The present invention relates to a built-in refrigerator comprising a carcass, in the lower rear area of which a machine compartment is formed. Since, if the carcass is incorporated into a cabinet niche, this machine compartment is countersunk deep into the niche, it is problematical to ensure adequate cooling of the units accommodated in the machine compartment by exchanging air with the environment.

One conventional approach to solving this problem is to embody a flue between a rear wall of the carcass and a rear wall of the cabinet niche, in which flue heated air can rise in the machine compartment, as a result of which cooling air is fed from below into the machine compartment. Such a solution is unsatisfactory since it takes up considerable space in the machine compartment such that the proportion of useable cooling chamber inside the carcass drops marginally by comparison with the volume of the cabinet niche.

DE 199 33 603A1 discloses the provision of a ventilator for forcedly ventilating the machine compartment. As a result, a flue for discharging the warm air is superfluous. A base region of the cabinet receiving the refrigerator, which is separated from the built-in niche by means of a base plate, is subdivided by a longitudinal wall into two flow channels, which extend between a front side of the cabinet and openings functioning as an inlet or, as the case may be, outlet opening for the machine compartment, said openings being cut into the base plate. The two openings and the separating wall require the cabinet to be extensively adjusted to the refrigerator to be built-in, so that aside from the all the purchasing costs of the refrigerator, the consumer is also subjected to labor costs for the installation thereof which are not yet negligible.

BRIEF SUMMARY OF THE INVENTION

There is thus a demand for a built-in refrigerator with a machine compartment formed in the lower rear region of the carcass, the assembly of which into a cabinet requires minimal adjustment outlay.

The object is achieved on the one hand in that the machine compartment is at least partially closed by a rear wall, which delimits a first air passage of the machine compartment at the level of a support area of the carcass.

This delimitation suffices with a single opening in the base plate of the cabinet niche, through which both the inflow and also the outflow of cooling air for the machine compartment, the one via the passage delimited by the rear wall and the other outside the passage, can pass. It also allows the rear wall belonging to the carcass and independent of the cabinet to embody the flow channel for the cooling air at the level of the machine compartment with minimal projections and this to keep the flow resistance thereof as minimal as possible.

To achieve an effective air recirculation in the machine compartment, the rear wall is preferably part of a housing, in which a compressor and/or a condenser is accommodated and a ventilator is arranged on a second air passage of the housing.

From a flow-specific point of view, a condenser with a coolant tube coiled around a longitudinal axis is preferred, said coolant tube being accommodated in a tubular section of the housing which is concentric in respect of the longitudinal axis.

A tray which is separated from the carcass preferably belongs to the refrigerator, said tray then being assemblable below the carcass on an underside of the rear wall in order to lengthen the flow channel delimited by the rear wall below the carcass.

To achieve an adequately sealed connection of the tray, this preferably has a flange which protrudes beyond the support area of the carcass. This expediently rests on an exterior of the rear wall so that it is possible to insert the carcass of the refrigerator from one open front side of the cabinet niche, while the tray is already assembled.

A simple and quicker assembly of the tray is enabled by means of guide rails, which can be assembled on an underside of the base plate of the niche in order to hold the tray to said underside.

An extensible tubular support of the tray can elongate the flow channel up to an opening formed in a front wall of the base region, without the dimensions of the tray having to be adjusted precisely to the depth of the base region. Flow channels for supply and discharged air can be guided in a precisely separate fashion up to this opening in the front wall.

The tray can be used to evaporate the condensate in the refrigerator, if a condensate drainage passes from the carcass into the tray.

If the carcass of the refrigerator is accommodated in a niche of a cabinet and the tray is accommodated in a base section of the cabinet, a gap is preferably provided between a base plate and a rear wall of the niche, via which the base section communicates with the niche and in which the first air passage and a second air passage are delimited from one another by means of the rear wall of the carcass. Only one single gap, instead of several separate openings in the base plate is thus needed to ventilate the machine compartment. This simplifies the adjustment of the cabinet to the refrigerator and is additionally advantageous in that a cabinet niche, which has already been used to accommodate a conventional refrigerator which is ventilated through the base region and via a flue on the rear side of the carcass, can essentially be used without the need for adjustment in order also to accommodate the inventive device.

BRIEF DESCRIPTION OF THE DRAWINGS

Further features and advantages of the invention result from the description below of exemplary embodiments with reference to the appended Figures, in which;

FIG. 6 shows a horizontal section through the cabinet and the carcass in FIG. 5 and FIG. 7 shows a perspective view of a condenser.

DETAILED DESCRIPTION OF THE PRESENT INVENTION

Figure 1:
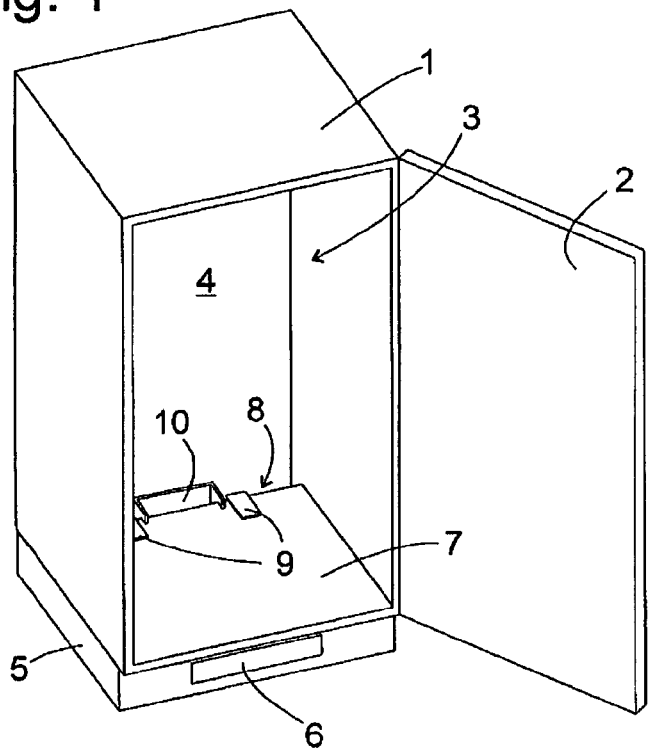
FIG. 1 shows a schematic front view of an inventive cabinet prepared for receiving a refrigerator carcass.

FIG. 1 shows a perspective view of a cabinet, which is provided in order to accommodate a built-in refrigerator. The cabinet has a square body 1, to which a door 2 is jointed and which delimits a built-in niche, which is provided in order to accommodate the carcass of the refrigerator. A rear wall 4 of the built-in niche can form part of the cabinet body 1, it could however also be formed by a wall of a building, in front of which the cabinet is mounted. The body 1 makes contact with a hollow base section 5, on the front side of which a ventilation opening 6 is formed. A gap 8 extends across the entire width of the built-in niche 3 between the rear wall 4 and the rear edge of a base plate 7 of the built-in niche 3.

Two holding clamps 9 of carrier sections which are concealed below the base plate 7 engage with the rear edge of the base plate 7 and, between the holding clamps 9, a rear section 10 of a tray 11 shown in detail in FIG. 3, said tray extending below the base plate 7 between the gap 8 and the ventilation opening 6.

Figure 2:
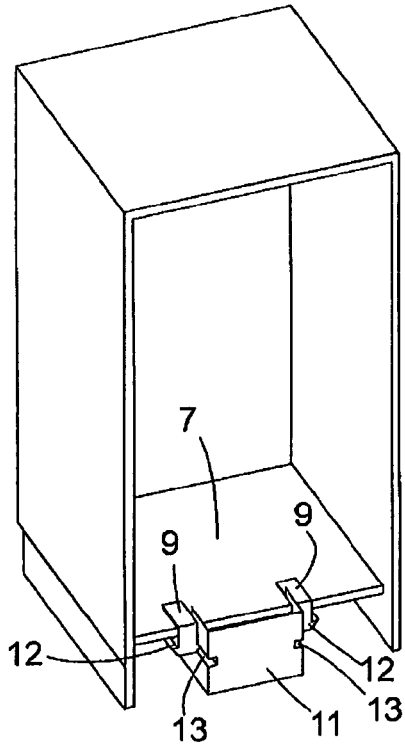
FIG. 2 shows a rear view of the cabinet from FIG. 1

FIG. 2 shows a view of the cabinet from the rear, with the rear wall 4 being omitted in order to be able to show the interior of the niche 3. In this view, the carrier sections 12, which are connected to the holding clamps 9, of an inverted T-shaped cross-section can be seen, which extend below the base plate 7. The side walls of the tray 11 are each provided with a groove 13 which extends in the horizontal direction, into which groove the carrier sections 12 engage and hold the tray 11 in a displaceable fashion. The carrier sections 12 constantly hold the tray 11 at a well-defined distance from the base plate 7 so that the upper edges of the side walls of the tray 11 rest closely against the base plate 7 and effectively prevent air from exchanging between the interior of the tray 11 and its environment in the base section 4. As the tray 11 is suspended from the base plate 7, no adjustment in respect of its level to the level of the base section 5 is necessary.

Figure 3:
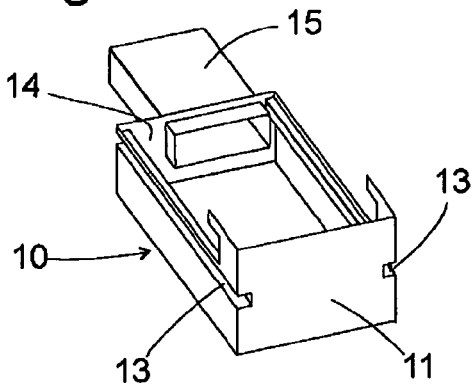
FIG. 3 shows an enlarged representation of a tray assembled in a base region of the cabinet.

As shown in FIG. 3, the tray 11 has a front wall 14, into which an opening is cut, in which a tubular section 15 is guided in a telescopically displaceable fashion. During the assembly of the tray 11, the tubular section 15 is firstly fully removed und the tray 11 is then inserted into the base section 5 via the open rear thereof, with the grooves 13 being slid onto the carrier sections 12. Once the tip of the tubular section 15 strikes the front wall of the base section 5 at the level of the ventilation opening 6, the tubular section 15 is moved back into the interior of the tray 11 until its rear section 10 strikes the rear edge of the base plate 7.

If the tray 11 is mounted and fastened in this way to the base section 5, the cabinet can be positioned in front of a wall of a building in order then to assemble a refrigerator carcass in the niche 3.

Figure 4:
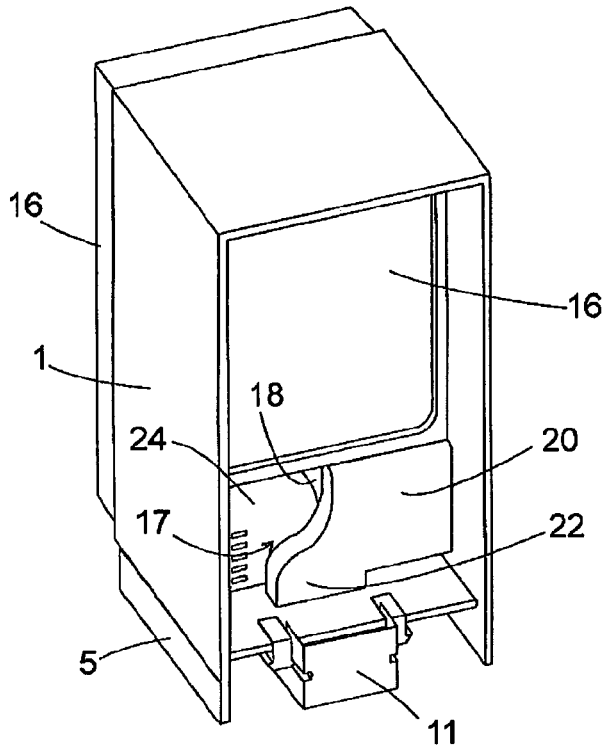
FIG. 4 shows a view similar to that in FIG. 2, which shows the cabinet with an incompletely inserted refrigerator carcass.
Figure 5:
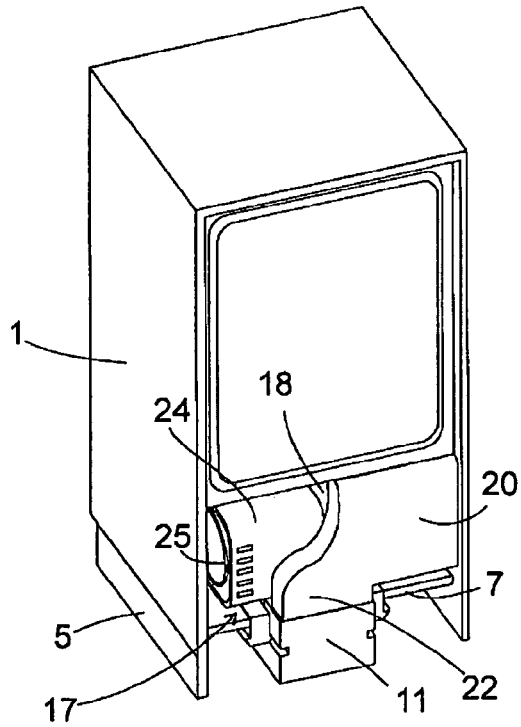
FIG. 5 shows a view of the cabinet similar to that in FIG. 4 with a completely assembled carcass

FIG. 4 shows the cabinet in the same perspective as in FIG. 2, comprising a carcass 16 of a refrigerator which is not completely inserted into the built-in niche 3. A machine compartment 17 is formed in the carcass 16 in a rear lower section in a manner known per se. The machine compartment 17 is subdivided by a separating wall 18 which extends in the depth direction of the carcass 16 into an upstream section 19 and a downstream section 21 which is to a large degree closed by a rear wall 20 connected to the separating wall 18 (see also the sectional representation in FIG. 6). A tubular air outlet section 22 is formed on the rear wall 20, the open lower end of which in the position shown in FIG. 4 faces the base plate 7. The open end of the air outlet section 22 is located in the finished assembled position of the carcass 16 shown in FIG. 5 across the gap 8 and is surrounded on three sides by the rear section 10 of the tray 11 which protrudes beyond the base plate 7, so that the tray 11 delimits a discharged air channel which passes from the air outlet section 22 through the base section 5 to the ventilation opening 6.

A compressor 23 is accommodated in the downstream section 21 of the machine compartment. A tubular housing part 24 connects to an opening in the separating wall 18, in which housing part 24 a condenser 25 and ventilator 26 are accommodated.

As shown in detail in FIG. 7, the condenser 25 includes a tubular line 27 molded into a coil, said tubular line being passed through by refrigerant conveyed by the compressor 23. The coiled tubular line 27 extends concentrically in respect of the longitudinal axis of the housing part 24. An electric motor 28 of the ventilator 26 is arranged in the hollow interior of the tubular line coil 27 and drives a rotor 29, which for its part drives a flow of cooling air through the machine compartment 17. The flow of cooling air proceeds in the base section 5 outside the tray 11 from the ventilation opening 6 through the gap 8 into the upstream section 19 of the machine compartment so that the cross-section of the gap 8 which is not filled by the rear section 10 of the tray can be considered as an air input opening of the machine compartment. The tubular housing part 24 bundles the flow of air so that it runs along the tubular line 27 at high speed and then flows frontally against the housing of the compressor 23. Air heated at the condenser 25 and compressor 23 leaves the downstream section 21 of the machine compartment through the air outlet section 22 of the rear wall 20 and flows back through the tray 11 to the ventilation opening 6.

A drainage line 30, by way of which condensate flows away from the interior 31 of the refrigerator, crosses the downstream section 21 of the machine compartment and ends at the level of the air outlet section 22, so that water leaving the drainage line 30 drops into the tray 11. Provided the ventilator 26 is operating, said draining line is thus exposed here to an intensive current of air which is heated at the condenser and compressor and thus dried, which effectively condenses the condensate in the tray 11.

The invention claimed is:

1. A built-in refrigerator comprising:

a cabinet including a lower rear area; and a machine compartment formed in the lower rear area, the lower rear area including a machine compartment support surface, the machine compartment being closed at least in part by an air guide which delimits a first air passage of the machine compartment, the air guide having an outlet positioned at the level of the machine compartment support surface of the cabinet, the outlet being positioned at the lower rear area to direct air flow along an air flow passage that is below the machine compartment support surface.

2. The built-in refrigerator as claimed in claim 1, further including a rear wall; the rear wall forming part of a housing in which a compressor and/or a condenser is accommodated; a second air passage associated with the housing; a ventilator is arranged on the second air passage of the housing.

3. The built-in refrigerator as claimed in claim 2, wherein the condenser includes a coolant tube which is concentrically wound around a longitudinal axis; the housing having a tubular section; the condenser being accommodated in the tubular section of the housing.

4. The built-in refrigerator as claimed in claim 1 further including a tray configured to be separated from the cabinet; the tray adapted to be assembled below the cabinet on an underside of the rear wall of the cabinet.

5. The built-in refrigerator as claimed in claim 4, wherein the tray includes a flange which protrudes beyond the support area of the cabinet; the flange resting against an exterior of the rear wall.

6. The built-in refrigerator as claimed in claim 4 further including guide rails; the guide rails adapted to be assembled on the underside of the cabinet in order to hold the tray on the underside of the cabinet.

7. The built-in refrigerator as claimed in claim 4, wherein the tray has an extensible tubular support.

8. The built-in refrigerator as claimed in claim 4 further including a condensate drainage; the condensate drainage running from the cabinet into the tray.

9. The built-in refrigerator as claimed in claim 4, wherein the cabinet includes a niche; the tray being accommodated in a base section of the cabinet; a gap located between a base plate and a rear wall of the niche which connects the base section to the niche; a second air passage associated with the housing; the first air passage and a second air passage located in the gap being delimited from one another by the rear wall of the cabinet.

10. The built-in refrigerator as claimed in claim 9, wherein the base section includes a window; the tray subdivides the base section into two flow channels which extend with opposite flow directions between the gap and the window of the base section.

11. A built-in refrigerator comprising:

a cabinet including a lower rear area;

a machine compartment formed in the lower area; the machine compartment being closed at least in part by an air guide which delimits a first air passage of the machine compartment at the level of a support area of the cabinet; and a tray configured to be separated from the cabinet; the tray adapted to be assembled below the cabinet on an underside of the rear wall of the cabinet, wherein the cabinet includes a niche; the tray being accommodated in a base section of the cabinet; a gap located between a base plate and a rear wall of the niche which connects the base section to the niche; a second air passage associated with the housing; the first air passage and a second air passage located in the gap being delimited from one another by the rear wall of the cabinet.

12. The built-in refrigerator as claimed in claim 11, wherein the base section includes a window; the tray subdivides the base section into two flow channels which extend with opposite flow directions between the gap and the window of the base section.

13. A built-in refrigerator comprising:

at least one machine component including a compressor and/or a condenser;

a cabinet having a pair of side walls, a front side, and a rear side, a base plate extending between the side walls and defining an upper side and a lower side, the upper side at least partly forming a support surface and a machine compartment for the at least one machine component, the lower side defining in part a hollow channel, the base plate having a width extending from the front side to the rear side that is less than a width of the side walls, so as to form a gap extending from a rear edge of the base plate to a rear edge of the side walls, wherein a first flow path extends from the front side of the cabinet, through the hollow channel, though the gap and into the machine compartment, and a second air flow path extends from the machine compartment, though the gap and hollow channel, for venting towards the front side of the cabinet.

14. The built-in refrigerator as claimed in claim 13, wherein the first flow path comprises an incoming air flow path, and the second air flow path comprises an outgoing air flow path.

15. The built-in refrigerator as claimed in claim 13, wherein the second air flow path is closed at least partly by an air guide having an outlet positioned at the level of the support surface.

16. The built-in refrigerator as claimed in claim 13, further comprising a tray positioned at least partly in the hollow channel, the tray comprising a part of the second air flow path.

17. The built-in refrigerator as claimed in claim 16, wherein the tray includes an inlet that is positioned at the level of the support surface.

18. The built-in refrigerator as claimed in claim 16, wherein the tray terminates adjacent a vent positioned at the front of the cabinet.

19. The built-in refrigerator as claimed in claim 16, wherein the tray includes a rear portion to engage with the rear edge of the base plate and a front portion that is displaceable relative to the rear portion, to adjustably extend towards the front side of the cabinet.

20. The built-in refrigerator as claimed in claim 13, wherein the gap extends along an entire distance between the side walls.

21. The built-in refrigerator as claimed in claim 13, wherein the gap consists of a single gap.

22. The built-in refrigerator as claimed in claim 13, further comprising a rear wall that defines at least a part of the first and/or second air flow passages.

23. The built-in refrigerator as claimed in claim 22, wherein the rear wall comprises a part of the cabinet.

24. The built-in refrigerator as claimed in claim 13, wherein the rear wall comprises a wall of a building.

* * * * *